US009423141B2

(12) United States Patent
Ojeda

(10) Patent No.: US 9,423,141 B2
(45) Date of Patent: Aug. 23, 2016

(54) CONSOLE HUMIDIFIER

(71) Applicant: Sunbeam Products, Inc., Boca Raton, FL (US)

(72) Inventor: Carlos Ojeda, Boynton Beach, FL (US)

(73) Assignee: Sunbeam Products, Inc., Boca Raton, FL (US)

( * ) Notice: Subject to any disclaimer, the term of this patent is extended or adjusted under 35 U.S.C. 154(b) by 351 days.

(21) Appl. No.: 14/358,806

(22) PCT Filed: Nov. 30, 2012

(86) PCT No.: PCT/US2012/067273

§ 371 (c)(1),
(2) Date: May 16, 2014

(87) PCT Pub. No.: WO2013/082414

PCT Pub. Date: Jun. 6, 2013

(65) Prior Publication Data

US 2015/0084215 A1 Mar. 26, 2015

Related U.S. Application Data

(60) Provisional application No. 61/565,553, filed on Dec. 1, 2011.

(51) Int. Cl.

| | |
|---|---|
| ***F24F 6/00*** | (2006.01) |
| ***F24F 6/04*** | (2006.01) |
| ***F24F 13/20*** | (2006.01) |

(52) U.S. Cl.

CPC . *F24F 6/00* (2013.01); *F24F 6/043* (2013.01); *F24F 13/20* (2013.01); *F24F 2006/008* (2013.01)

(58) Field of Classification Search

CPC ..... F24F 6/00; F24F 6/043; F24F 13/20; F24F 2006/008

USPC ..... 261/104, 107, 30, DIG. 65

See application file for complete search history.

(56) References Cited

U.S. PATENT DOCUMENTS

| | | | | |
|---|---|---|---|---|
| 1,646,329 | A | 10/1927 | Ulrich | |
| 2,032,634 | A | 3/1936 | Ross | |
| 2,054,200 | A | 9/1936 | Langford | |
| 2,556,910 | A * | 6/1951 | Feldman | F24F 6/043 239/44 |
| 5,061,405 | A | 10/1991 | Stanek et al. | |
| 5,133,904 | A | 7/1992 | Pepper | |

(Continued)

FOREIGN PATENT DOCUMENTS

| | | |
|---|---|---|
| JP | 2009036407 | 2/2009 |
| JP | 201112337 | 6/2011 |

*Primary Examiner* — Charles Bushey
(74) *Attorney, Agent, or Firm* — Seth M. Blum

(57) ABSTRACT

A console humidifier includes a humidification unit having a top portion with an air outlet there through. A water reservoir is located at a bottom portion of the humidification unit, and includes an air inlet there through. A portion of the water reservoir extends through a back wall of the humidification unit and includes a water tank interface. A water tank is positionable on the water tank interface, where the water tank include support members for caring the load of the water tank. A wick element is located in the humidification unit, with only an end portion of the wick element being positioned in the reservoir. The wick element being positioned about the air inlet. A fan assembly is located in the top portion of the humidification unit, where the fan assembly is interposed between the wick element and the air outlet in the top portion of the humidification unit.

19 Claims, 12 Drawing Sheets

(56) References Cited

U.S. PATENT DOCUMENTS

| | | | | |
|---|---|---|---|---|
| 5,447,663 | A | 9/1995 | Dix et al. | |
| 5,480,588 | A * | 1/1996 | Tomasiak | F24F 6/043 261/104 |
| 6,176,474 | B1 | 1/2001 | Stanek et al. | |
| 6,248,155 | B1 | 6/2001 | Seaman | |
| 6,592,107 | B1 * | 7/2003 | Wong | F24F 6/02 261/107 |
| 6,824,126 | B2 | 11/2004 | Keller et al. | |
| 7,499,632 | B2 * | 3/2009 | Granger | A01M 1/2033 392/386 |
| 2002/0180073 | A1 * | 12/2002 | Mulvaney | F24F 6/043 261/104 |
| 2012/0267804 | A1 * | 10/2012 | Rodrigs | F24F 6/04 261/64.1 |
| 2013/0175711 | A1 * | 7/2013 | Nutter | F24F 6/02 261/30 |

* cited by examiner

CONSOLE HUMIDIFIER

FIELD OF THE INVENTION

The invention relates to portable humidifiers, and more particularly to a console humidifier having a self supporting water tank(s).

BACKGROUND OF THE INVENTION

Conventional home humidifiers can include a water reservoir or tank for supplying a continuous feed of water to a wick element. The wick element can be made of a honeycomb or other suitable form, having only an end portion positioned in the water reservoir. A wicking action causes water to travel up through the wick element, saturating the wicking element.

An air blower is used to blow a stream of air across the wick element. The air blower is positioned adjacent to the wick element, to draw outside air across the wick element. The air stream travels across the wick element, transferring moister from the wick element into the air stream as water vapor. This moistened air is then discharged from the humidifier.

SUMMARY OF THE INVENTION

The present disclosure provide a console humidifier. The console humidifier includes a humidification unit having front, back, top, and bottom portions defining an interior space. A reservoir is positioned at the bottom portion of the humidification unit, in the interior space. The reservoir includes a centrally located air inlet and a water tank interface extending through the back portion of the humidification unit. The humidification unit farther includes an air outlet through which air may exit the interior space of humidification unit.

A wick element is included, having a first end and a second end, where the first end is removeably positionable in the reservoir about the air inlet. The wick element can include a closed loop side wall defining an open channel between the first end and the second end. A sealing cap can be removeably positionable on the second end of the wick element, the sealing cap closing the open channel at the second end of the wick element At least one water tank is included with the humidifier. The at least one water tank includes a bottom end having a pair of support members defining a recess portion there between. The water tank is removeably positionable on the water tank interface with the water tank interface located in the recess portion of the water tank. When positioned on the water tank interface, the support members of the water tank carry the load of the water tank. The water tank can include a valve located in the recess portion. The water tank interface actuates the valve into an open position when the water tank is positioned on the water tank interface. The valve can be a spring loaded valve, biased in the closed position.

A fan assemble is located in the interior space of the humidification unit, interposed between the air outlet and the wick element. A control panel is used to energizing the motor of fan assembly, where an air flow control can be actuated from an "off" position to an "on" position, for example, to a low, medium, high position. The motor rotates the fans to create airflow through the interior space of the humidification unit. The rotation of the fans draws air in through the air inlet in the water reservoir base. The air is drawn into the open center channel of the wick element. The sealing cap prevents the air flow from exiting the wick element through the second end, instead drawing the air flow though the side wall of the wick element. As air the air flow passes through the side wall of the wick element, moisture is absorbed from the wick element into the air flow. The fan assembly discharges the moisten air thought the grill openings at the top of the humidification unit.

BRIEF DESCRIPTION OF THE DRAWINGS

A more complete understanding of the present invention, and the attendant advantages and features thereof, will he more readily understood by reference to the following detailed description when considered in conjunction with the accompanying drawings wherein:.

DETAILED DESCRIPTION OF THE INVENTION

Figure 1:
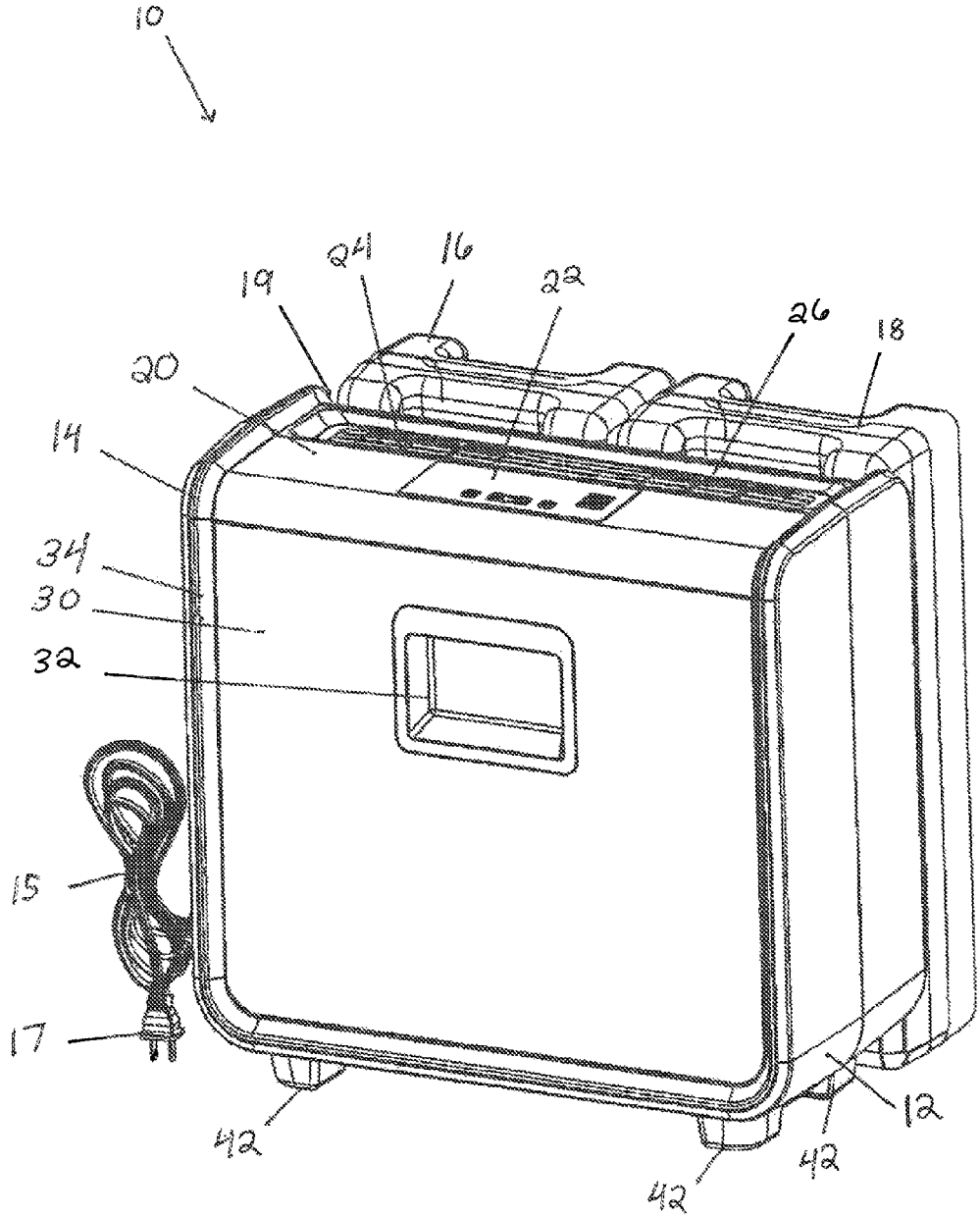
FIG. 1 depicts a front perspective view of the console humidifier of the present disclosure.

Referring now to the drawing figures in which like reference designators refer to like elements, there is shown in FIG. 1 a console humidifier 10 of the present disclosure. The console humidifier 10 includes a water reservoir base 12 on which a humidification unit 14 is mounted. Water tanks 16 and 18 are positioned adjacent to a back surface 19 of the humidification unit 14, in fluid engagement with the water reservoir base 12.

A top portion 20 of the humidification unit 14 includes a control panel 22. The control panel 22 is mounted in a fixed compartment between a pair of discharge grill openings 24 and 26 defining air outlets. The control panel 22 functions similar to prior art humidifiers, controlling the discharged airflow from the humidification unit 14. The discharge grill openings 24 and 26 can include a plurality of movable louvers which can be adjusted to control the direction and/or volume of the discharged airflow from the humidification unit 14. A power cord 15, fitted with a power plug 17, extends from humidification unit 14, supplying electrical power from a household electrical receptacle to the console humidifier 10.

Figure 2:
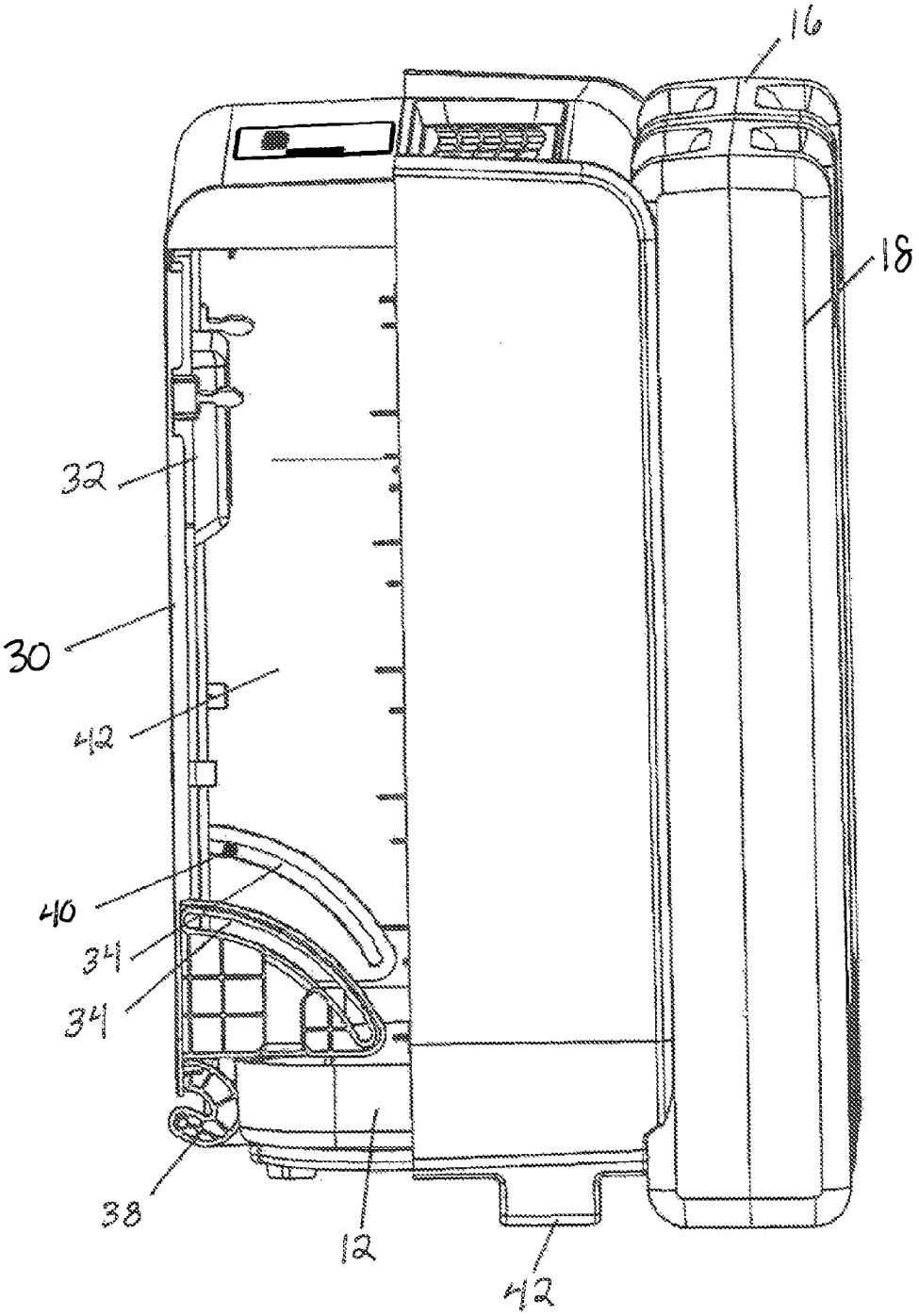
FIG. 2 depicts a side sectional view of the console humidifier of the present disclosure.

A door 30, including a handle 32, is rotatably mounted to a front portion 34 of the humidification unit 14. The door 30 can be opened to allow access to an interior space of the humidification unit 14. Referring also to FIG. 2, the door 30 can be rotatably mounted 36 to the water reservoir base 12. In this manner, the door 30 can be opened by being rotated downwardly, with respect to water reservoir base 12, to allow access to the interior space of the humidification unit 14. The door 30 can include curved guide tracks 38 positioned on opposite sides of the door 30. The curved guide tracks 38 engage guide pins 40 mounted to an interior surface 42 of the humidification unit 14. The combination of curved guide tracks 38 and guide pins 40 define a rotational path of the door 30, and substantially prevent an over rotation of the door 30 with respect to the water reservoir base 12 when opening.

Figure 3:
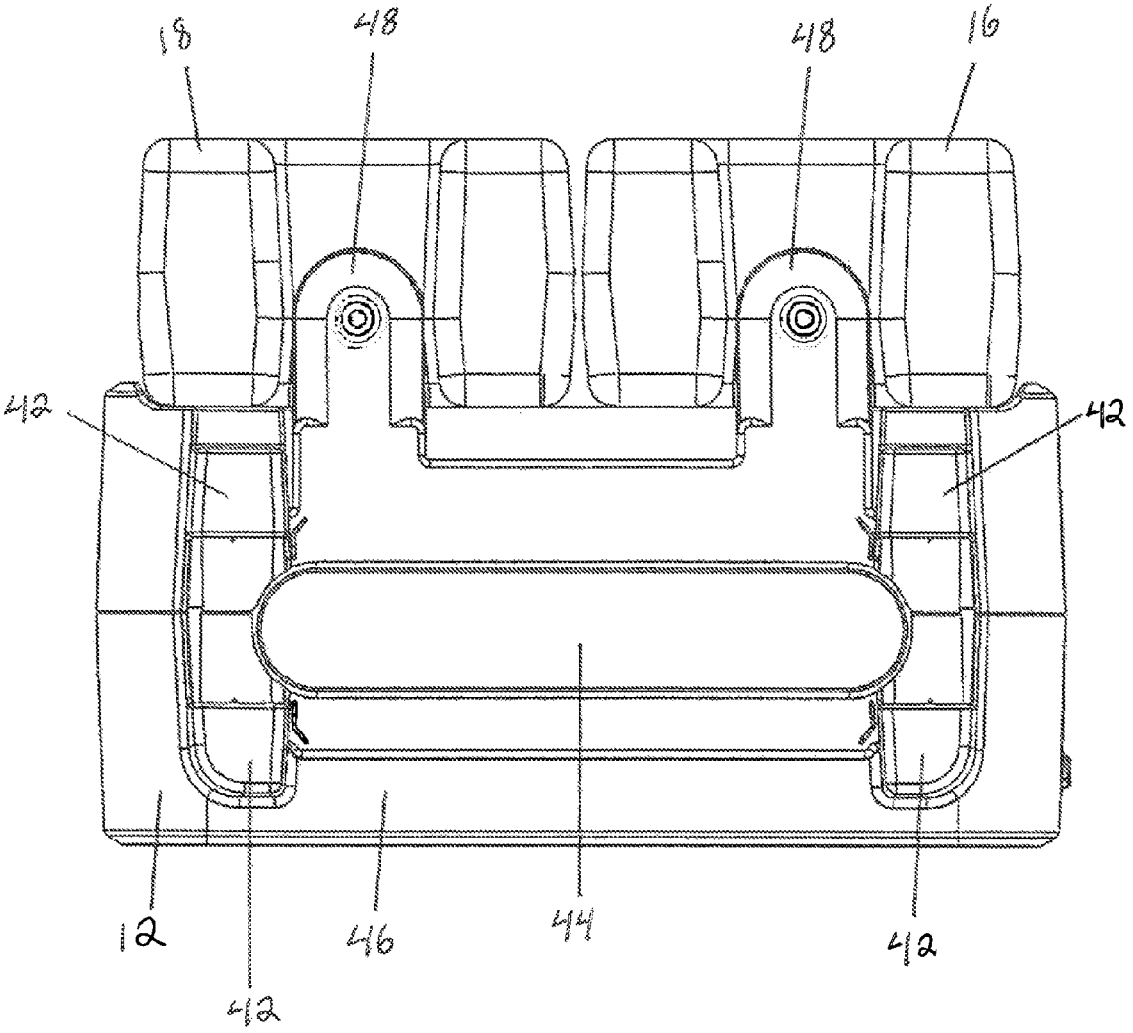
FIG. 3 depicts a bottom view of the console humidifier of the present disclosure.
Figure 4:
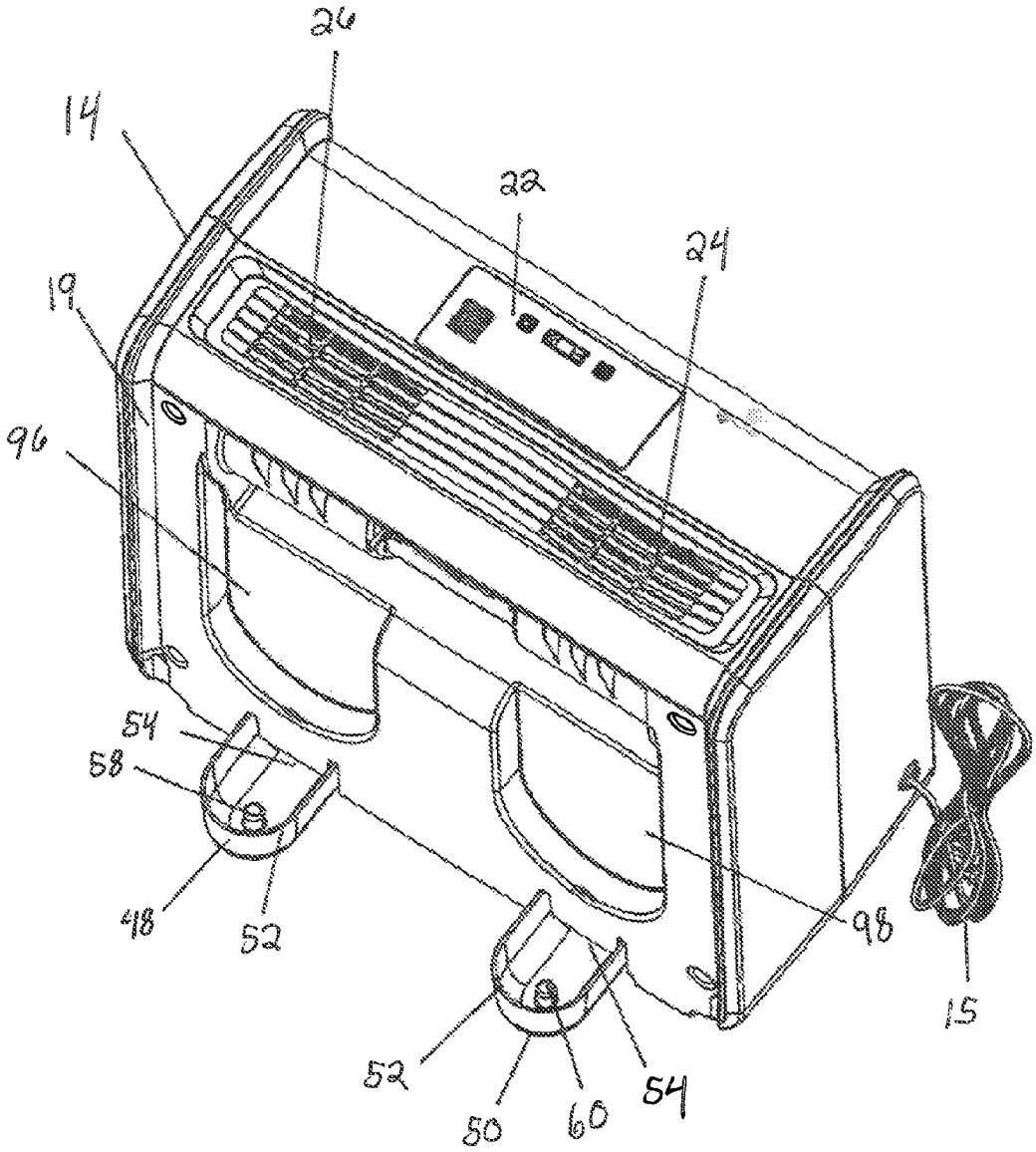
FIG. 4 depicts a rear perspective view of the console humidifier of the present disclosure without the water tanks.

Referring to FIGS. 3 and 4, the water reservoir base 12 includes a plurality of feet 42 for supporting the humidification unit 14 at a spaced distance from a support surface. An air inlet 44 is provided in a bottom surface 46 of the water reservoir base 12. The plurality of feet 42 provide spacing between a bottom of the water reservoir base 13 and the support surface to provide an air flow path to the air inlet 44. The air inlet 44 allows for outside air to be drawn into the humidifier unit 14. The water reservoir base 12 further includes a pair of water tank interface 48 and 50 extending outwardly there from, through the back surface 19 of the humidification unit 14. The water tank interfaces 48 and 50 include an upwardly extending outer wall 52 to define a fluid path. 54 into water reservoir base 12. Each of the water tank interface 48 and 50 each include an upwardly extending stem 58 and 60 for actuating a valve on the water tanks 16 and 18, as will discussing in more detail below.

Figure 5:
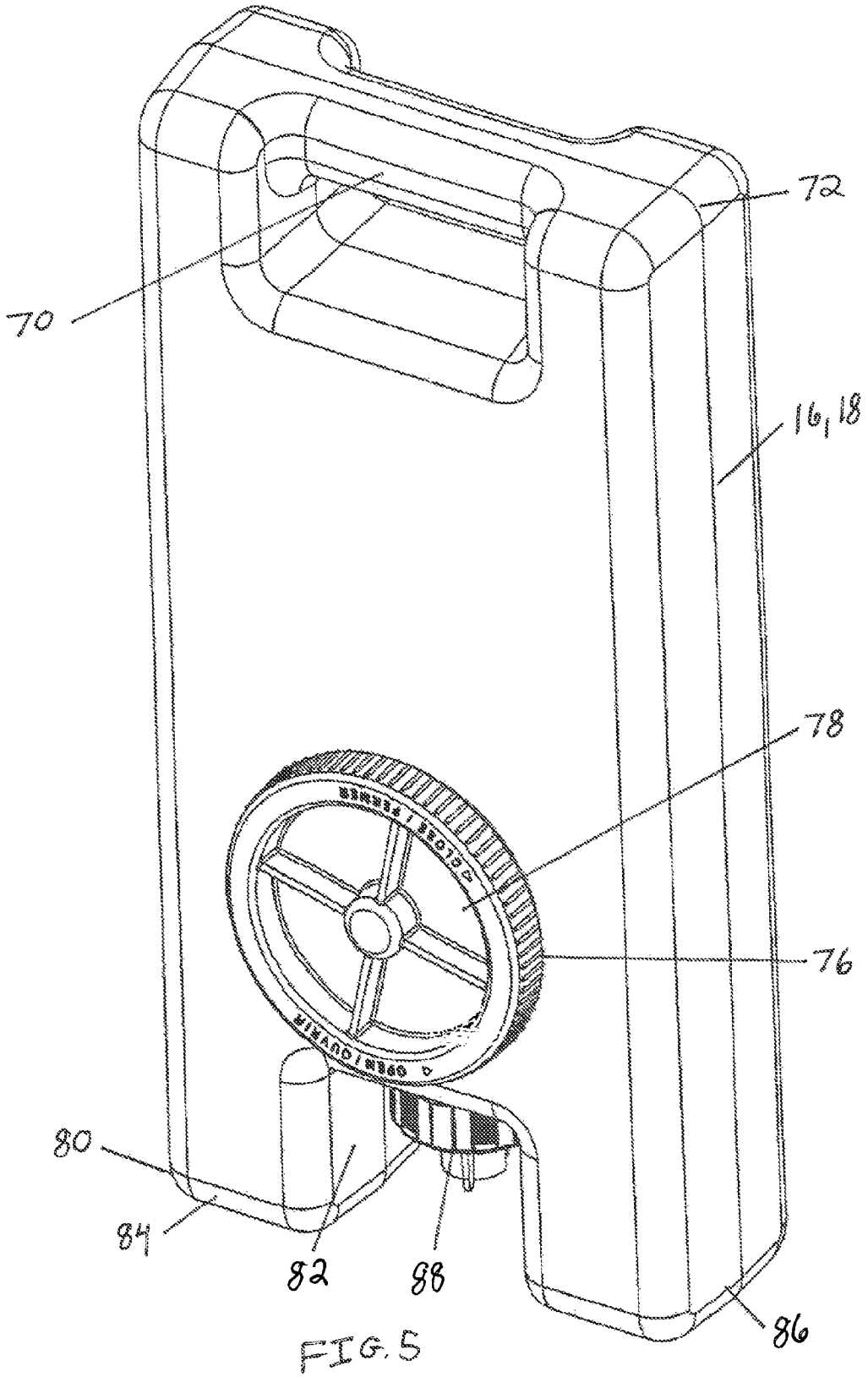
FIG. 5 depicts a front perspective view of a water tank for use with the console humidifier of the present disclosure.

Referring to FIG. 5, the water tanks 16 and 18 each include a handle 70 positioned at a top end 72 thereof. The handle 70 can be integrally molded and formed with the water tank 16, 18. A front wall 74 of the water tank 16, 18 includes a fill opening 76 over which a fill cap 78 is attached. The fill cap 78 can be threadably attached to the fill opening 76, sealing the fill opening 76. A sealing ring (not shown) can be positioned between the fill cap 78 and fill opening 76.

Figure 6:
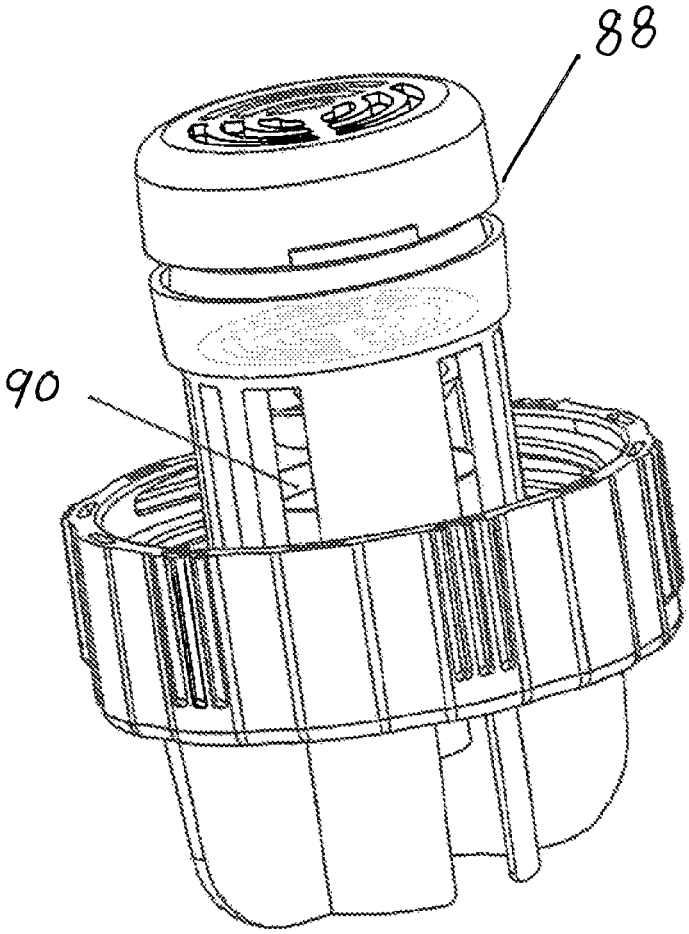
FIG. 6 depicts a spring loaded valve for use in the water tank of FIG. 5.

A bottom end 80 of the water tank 16, 18 includes a central recess 82, such that a pair of support members 84 and 86 defined about the recess 82. The support members 84 and 86 support the water tank 16, 18 in a vertical orientation when positioned on the water tank interface 48, 50 of the water reservoir base 12. A valve 88 is located in the recess 82, though the bottom end 80 of the water tank 16, 18. The valve 88 can be a spring biased valve, where the spring 90 biases the valve 88 into a closed position. (See FIG. 6). When the water tank 16, 18 is positioned on the water tank interface 48, 50 of the water reservoir base 12 the upwardly extending stem 58, 60 engages the valve 88, force the spring 90 upward so that the valve 88 is opened. In this manner, the water from the water tank 16, 18 can be discharged though the valve 88, through the water tank interface 48, 50, into the water reservoir base 12. The water will continue to be discharge from water tank 16, 18 into the water reservoir base 12 until the water level in the water tank interface 48, 50 reaches a level to prevent air from entering the water tank 1 6, 18 through the valve 88, at which point the discharge of water from the water tank 16, 18 will halt. When the water level in the water tank interface 48, 50 decreases sufficiently to allow air to enter the water tank 16, 18 thought the valve 88, water will again be discharged from the water tank 16, 18 into the water reservoir base 12.

Figure 7:
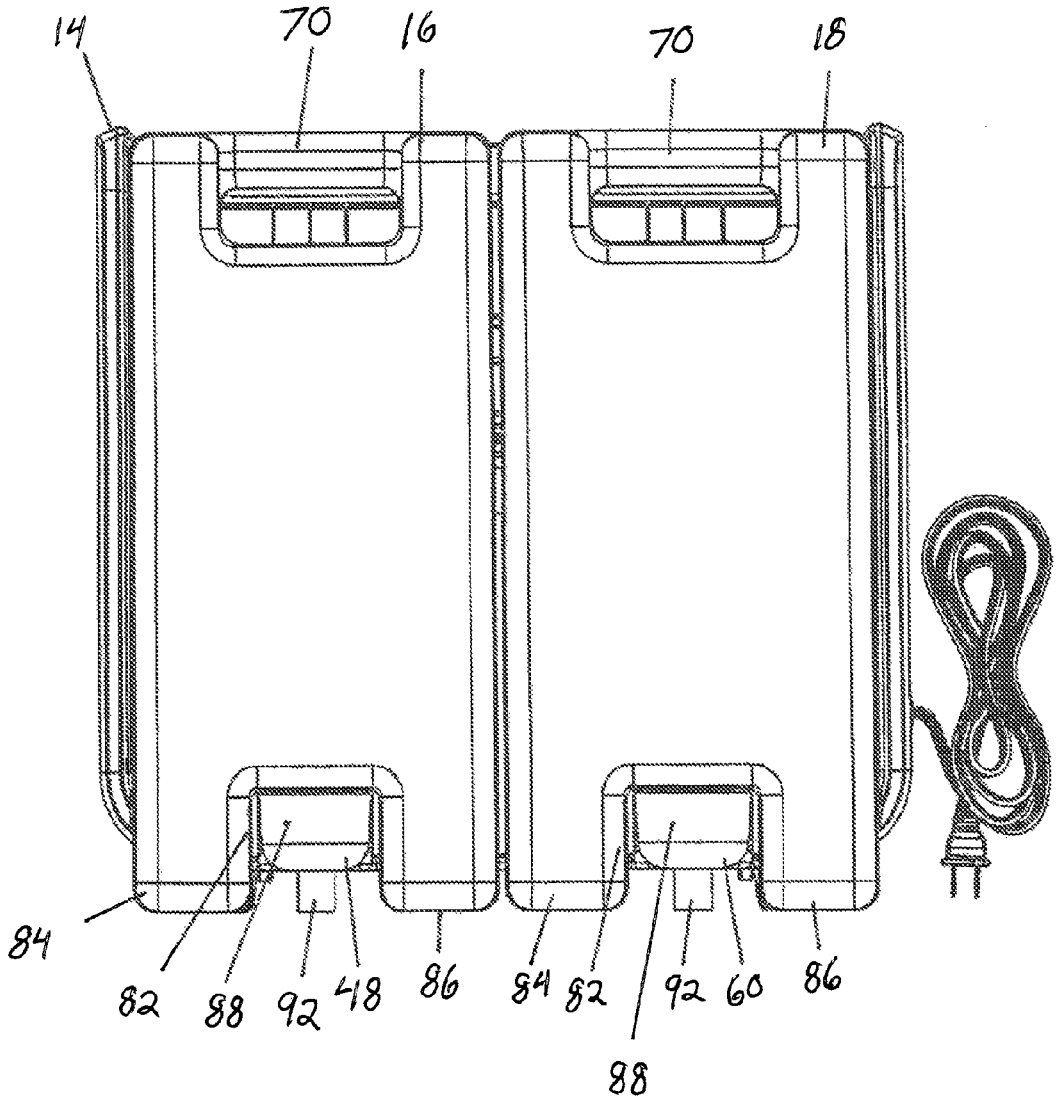
FIG. 7 depicts a rear view of the console humidifier of the present disclosure.

Referring to FIG. 7, the water tanks 16, 18 are positioned on the water tank interfaces 48, 50, such that the water tank interfaces 48, 50 are located within the recesses 88, aligned with the valves 88. The support members 84, 86 of the water tanks 16, 18 extend downward, about the water tank interface 48, 50, contacting the support surface, such, as a floor. In this manner; substantially all of the weight of the water tank 16, 18 is supported by the support members 84, 86. The downward force imparted by the water tank 16, 18 onto the water tank interface 48, 50 is substantially limited to the force imparted by the spring 90 in the valves 88 onto the stems 58, 60 in the water tank interfaces 48, 50. However, the water tank interfaces 48, 50 can include a support member 92 to support any load imparted to the water tank interface 48, 50 by the water tank 16, 18.

Referring again to FIG. 4, the back surface 19 of the humidification unit 14 can include indented portions 96, 98. The indented portions 96, 98 are sized to receive the fill caps 78 therein. In this manner, when the water tanks 16, 18 are positioned on the water tank interfaces 48, 50 the front wall 74 of the water tank 16, 18 will be substantially flush with the back surface 19 of the humidification unit 14.

Figure 8:
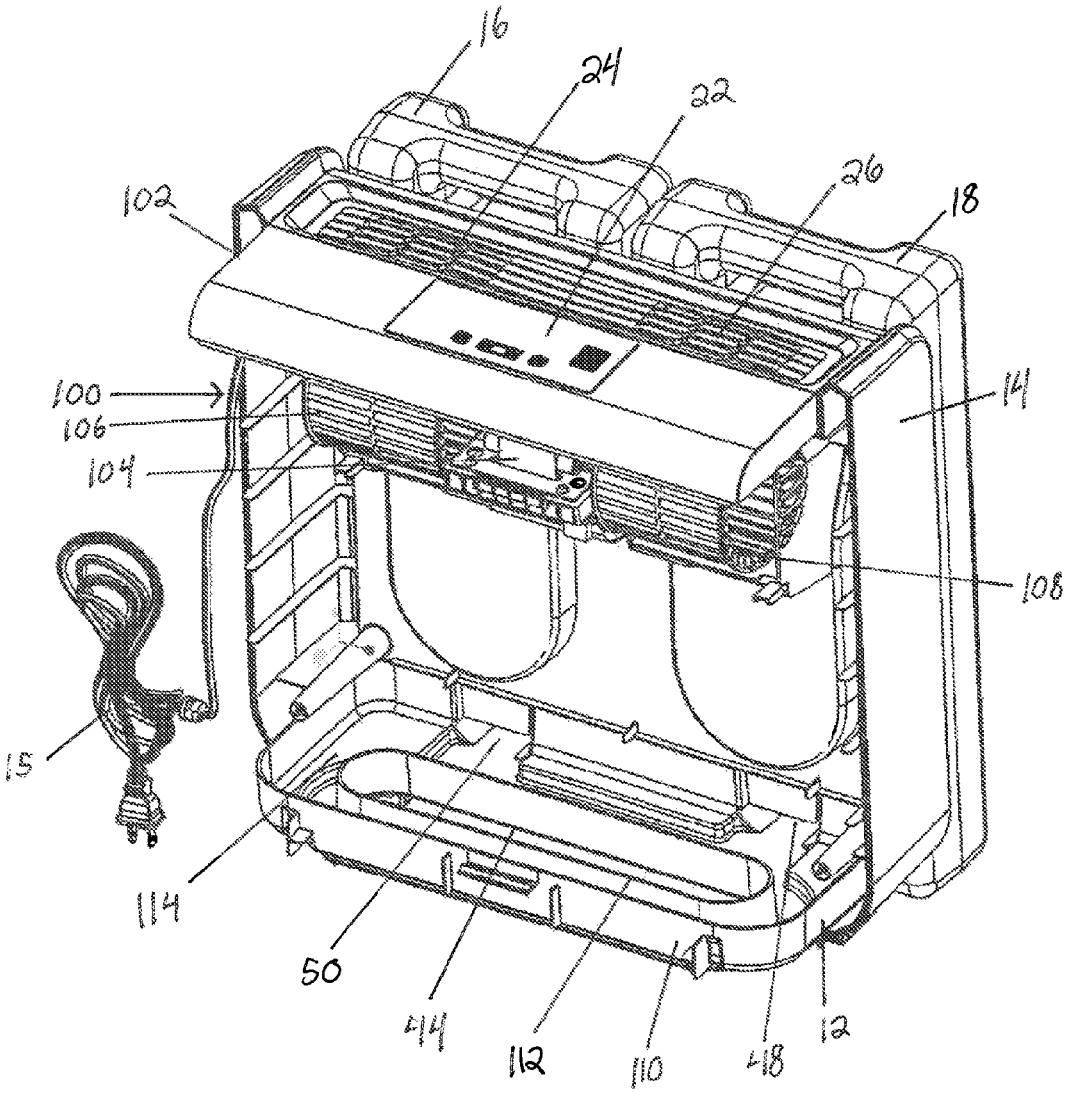
FIG. 8 depicts a front perspective sectional view of the console humidifier of the present disclosure.
Figure 9:
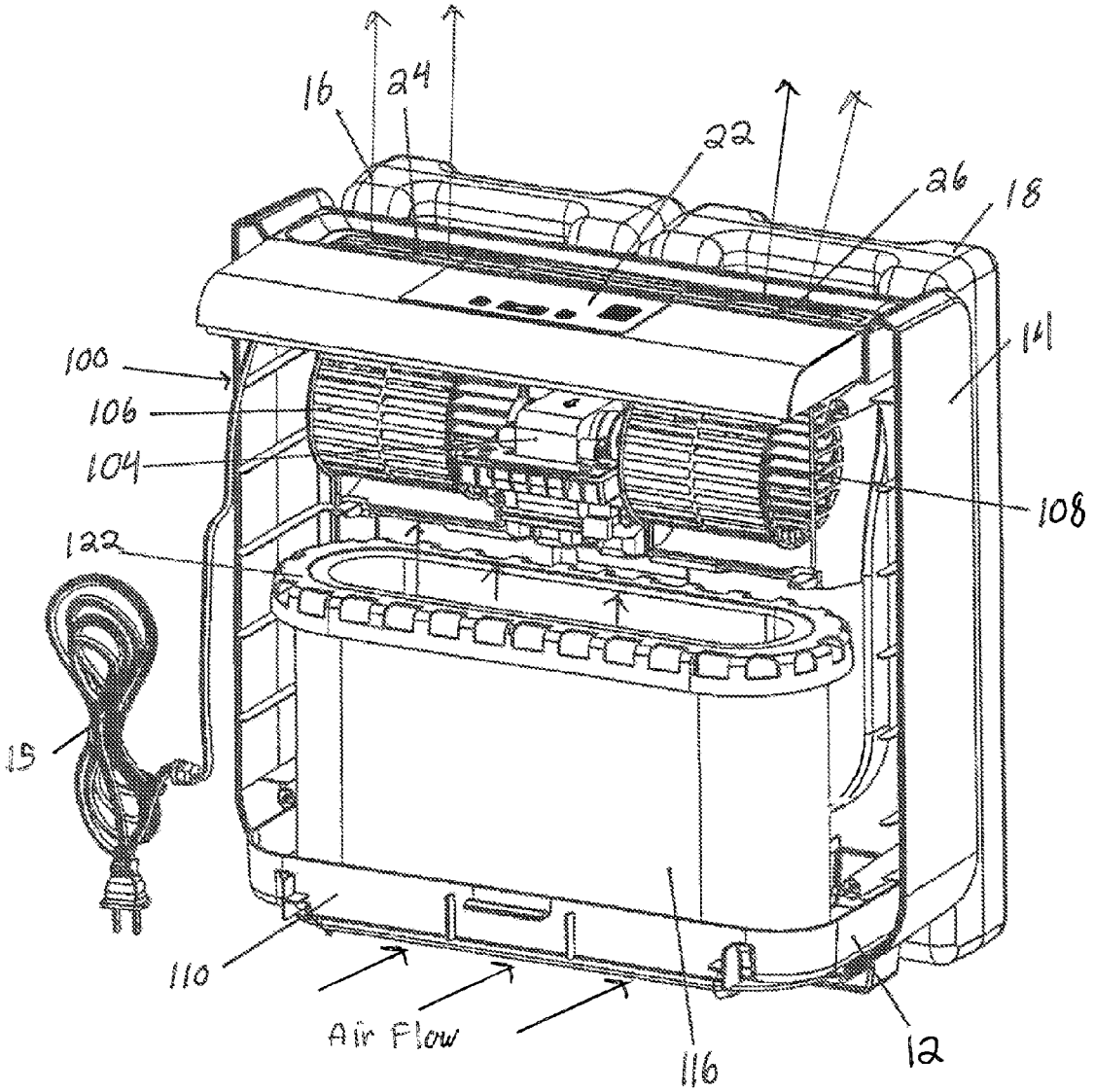
FIG. 9 depicts a front perspective sectional view of the console humidifier of the present disclosure with a wick element.

Referring to FIGS. 8 and 9, the humidification unit 14 includes a fan assembly 100 mounted at a top portion 102 of the humidification unit 14. The fan assembly 100 includes a motor 104 and a pair of fans 106 and 108 mounted thereto. Operation of the fan assembly 100 is controlled by the control panel 22.

The water reservoir base 12 has a raised outer wall 110 and a raised inner wall 112, about the air inlet 44. In this manner, a water reservoir 114 is defined about the air inlet 44, where the water reservoir 114 is in fluid communication with the water tank interfaces 48, 50.

A wick element 116 is positioned below the fan assembly 100, where a first end 118 of the wick element 116 is positioned in the water reservoir 114 and a second end 120 of the wick.

element 116 is positioned below, proximal, to the fan assembly 100. A open cap 122 can be positioned about the second end 120 of the wick element 116.

Figure 10:
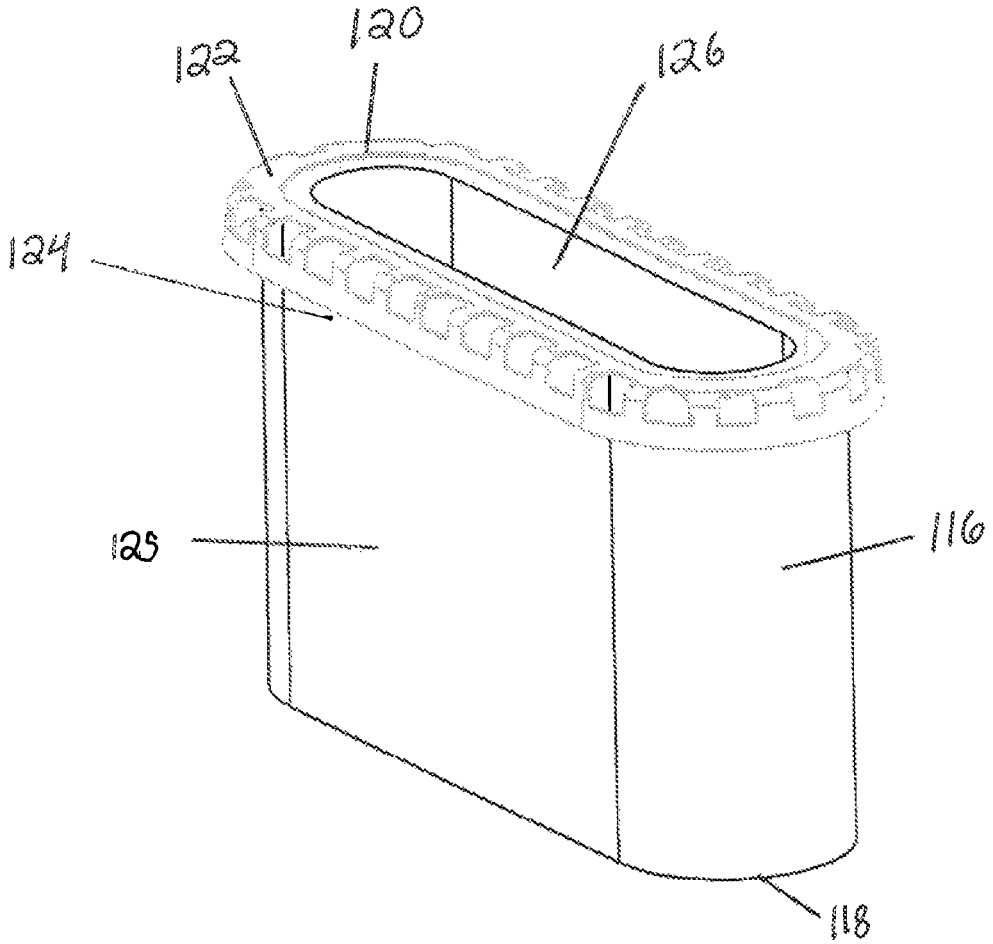
FIG. 10 depicts a wick element for use in the console humidifier of the present disclosure.

Referring also to FIG. 10, the wick element 116 can be in the form of a closed loop 124, having a side wall 125 defining an open center channel 126 for an air path there through. In such a configuration, the first end 118 of the wick element 116 is positioned in the water reservoir 114, about the air inlet 44, defining an air flow path through the air inlet 44, the open center channel 126 of the wick element 116, to the fan assembly 110.

The wick element 116 can be formed of a suitable sheet-like absorbent and capillary wick material, as described in detail in U.S. Pat. No. 4,822,533. As disclosed in that patent, the unitary web of non-woven, fibrous and absorbent wicking media maintain its shape and physical properties when in contact with water for extended periods of time. This material has been selected because it has sufficient absorption capacity as well as sufficient capillary action such that with only the first end 118 of the wick element 116 is submerged below the predetermined level of water within the water reservoir 114, the wick element 116 will absorb water and will wick the water vertically by capillary action along the entire height of the wick element 116 so that same is substantially uniformly wetted throughout.

In operation, to fill the water reservoir 114 with water the water tanks 16, 18 are removed from the water reservoir base 12 by grasping each handle 70 and lifting the water tanks 16 18 off the water reservoir base 12. Once removed, the water tank 16, 18 is laid down with the fill cap 78 facing upward. The fill cap 78 is removed, unscrewed, to expose the fill opening 76. Water can be poured into the water tank 16, 18 through the fill opening 76, or filled using a faucet. Once filled, the fill cap 78 is re-installed to seal the fill opening 76.

The filled water tanks 16, 18 arc repositioned on water tank interfaces 48, 50, such that the water tank interfaces 48, 50 is positioned with the recesses 88, aligned with the valves 88. The support members 84, 86 of the water tanks 16, 18 extend downward, about the water tank interfaces 48, 50, contacting the support surface, such as a floor.

When the water tanks 16, 18 are positioned on the water tank interfaces 48, 50 of the water reservoir base 12 the upwardly extending stems 58, 60 engages the valves 88, forcing the spring 90 upward so that the valves 88 are opened. In this manner, the water from the water tanks 16, 18 can be discharged though the valve 88, through the water tank interface 48, 50, into the water reservoir base 12. The water will continue to be discharge from water tanks 16, 18 into the water reservoir base 12 until the water level in the water tank interfaces 48, 50 reaches a level to prevent air from entering the water tanks 16, 18 through the valves 88, at which point the discharge of water from the water tanks 16, 18 Will halt. When the water level in the water tank interfaces 48, 50 decreases sufficiently to allow air to enter the water tanks 16, 18 thought the valve 88, water will again be discharged from the water tanks 16, 18 into the water reservoir base 12. The wicking element 116 will absorb and allow sufficient water to flow up into the wicking element 116 from the water reservoir 114.

To operate the console humidifier 10, the control panel 22 can be used to control the air flow. The control panel is used to energizing the motor 104 of fan assembly 100, where an air flow control can be actuated from an "off" position to an "on" position, for example, to a low, medium, high position. The motor 104 rotates the fans 106 and 108 to create airflow through the interior space of the humidification unit 14. Referring to FIG. 9, the rotation of the fans 106 and 108 draws air in through the air inlet 44 in the water reservoir base 12. The air is drawn in thought the open center channel 126 of the wick element 116. As the air flow passes through the open center channel 126 of wick element 11.6, moisture is absorbed from the wick element 116 into the air flow. The fan assembly 100 discharges the moisten air thought the grill openings 24 and 26 at the top of the humidification unit 114.

Figure 11:
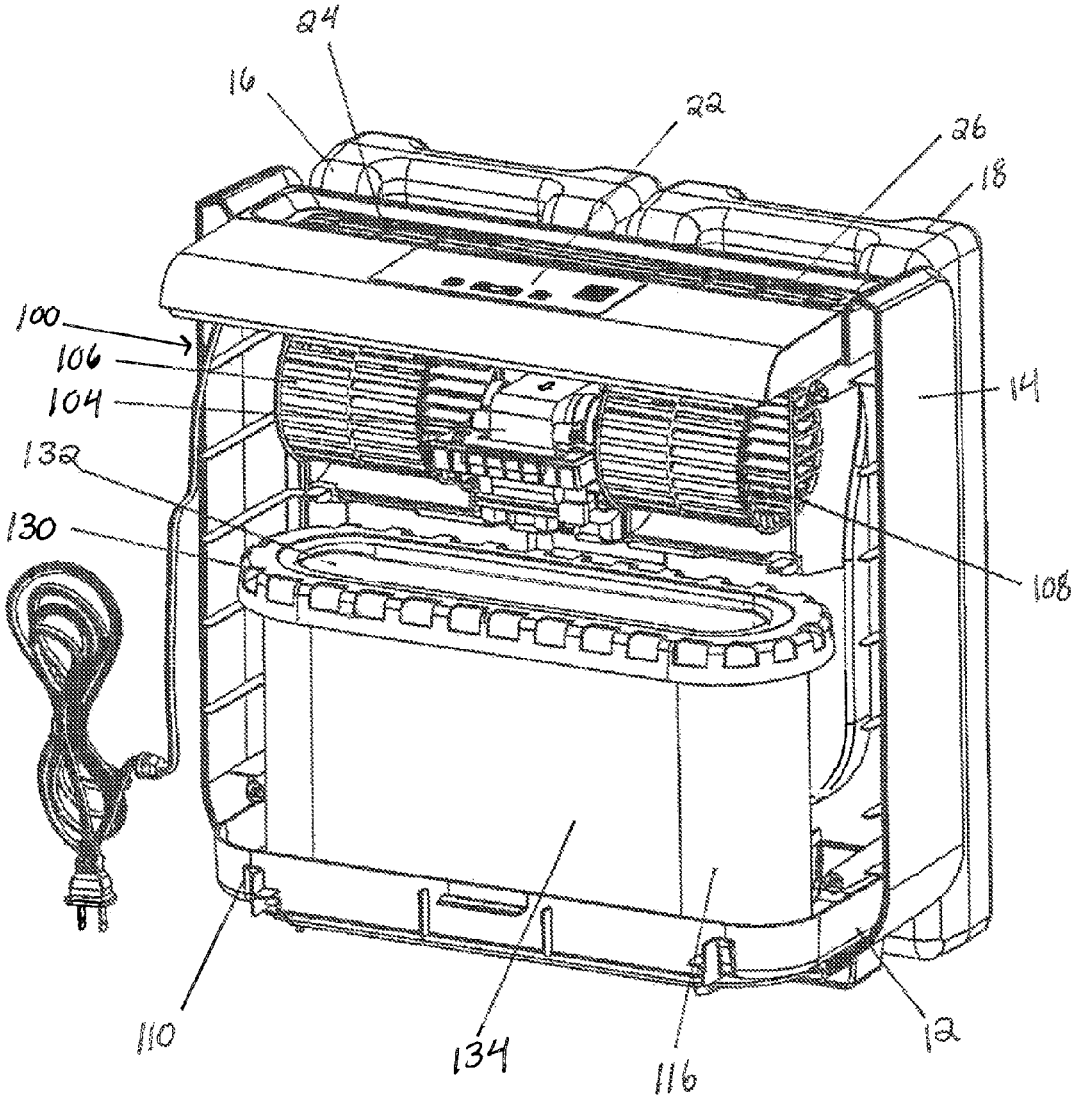
FIG. 11 depicts a front perspective sectional view of the console humidifier of the present disclosure with a sealed wick element.
Figure 12:
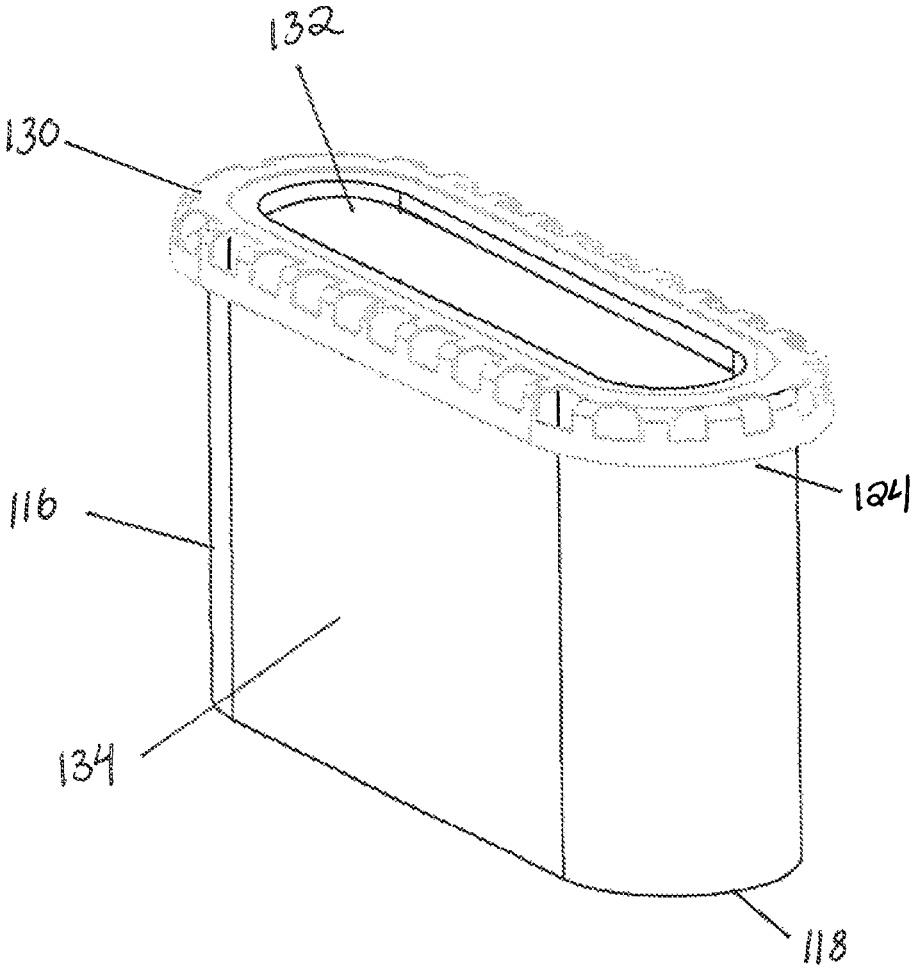
FIG. 12 depicts a sealed wick element for use in the console humidifier of the present disclosure.

Referring to FIGS. 11 and 12, in another embodiment, the wick element 116 is positioned below the fan assembly 100, where a first cud 118 of the wick element 116 is positioned in the water reservoir 114 and a second end 120 of the wick element 116 is positioned below, proximal, to the fan assembly 100. The wick element 116 can be in the form of a closed loop 124, having an open center channel 126 defining an air path there through. In such a configuration, the first end 118 of the wick element 116 is positioned in the water reservoir 114, about the air inlet 44, defining an air flow path through the air inlet 44 into the open center channel 126.

A sealing cap 130 can be positioned about the second end 120 of the wick element 116 The sealing cap 130 includes a sealing portion 132 which is positioned over the second end portion 120 of the open center channel 126. The sealing portion 132 seals the second end portion 120 of the open center channel 126, preventing air flow from exiting the wick element 116 through the second end 120.

To operate the console humidifier 10, the control panel 22 can be used to control the air flow. The control panel is used to energizing the motor 104 of fan assembly 100, where an air flow control can be actuated from an "off" position to an "on" position, for example, to a low, medium, high position. The motor 104 rotates the fans 106 and 108 to create airflow through the humidification unit 14. As the sealing cap 130 is positioned over second end 120 of the wick element 116, the air flow is drawn though the side wall 134 of the wick element 116.

In this manner, the rotation of the fans 106 and 108 drawing in air through the air inlet 44 in the water reservoir base 12. The air is drawn in to the open center channel 126 of the wick element 116. The sealing cap 130 prevents the air flow from exiting the wick element 116 through the second end 120, instead drawing the air flow though the side wall 134 of the wick element 134. As the air flow passes through the side wall 134 of the wick element 116, moisture is absorbed from the wick element 116 into the air flow. The fan assembly 100 discharges the moisten air thought the grill openings 24 and 26 at the top of the humidification unit 114.

All references cited herein are expressly incorporated by reference in their entirety.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

What is claimed is:

1. An humidifier comprising:

a humidification unit having front, back, top, and bottom portions defining an interior space;

a reservoir positioned at the bottom portion, in the interior space of the humidification unit, and includes a centrally located air inlet, wherein the reservoir is configured to retain a water supply about the air inlet;

an air outlet through which air may exit the interior space of humidification unit;

a wick element having a first end and a second end, wherein the first end is positionable in the reservoir about the air inlet;

a fan assemble interposed between the air outlet and the wick element;

a water tank positioned adjacent to an exterior surface of the back portion of the humidification unit and in fluid communication with the reservoir.

2. A humidifier as set forth in claim 1, wherein the reservoir includes a water tank interface extending through a back portion of the humidification unit, the water tank interface being in fluid communication with the water reservoir.

3. A humidifier as set forth in claims 2, wherein the water tank includes a bottom end having a pair of support members defining a recess portion there between, the water tank being positionable on the water tank interface with the water tank interface being located in the recess portion of the water tank.

4. A humidifier as set forth in claim 3, wherein the support members of the water tank carry the load of the water tank when positioned on the water tank interface.

5. A humidifier as set forth in claim 4, where in the water tank includes a valve located in the recess portion, the water tank interface actuating the valve into an open position when the water tank is positioned on the water tank interface.

6. A humidifier as set forth in claim 1, further comprising a door pivotally connected to the front portion of the humidification unit.

7. A humidifier as set forth in claim 1, wherein the wick element includes a closed loop side wall defining an open channel between the first end and the second end.

8. A humidifier as set forth in claim 7, the wick element further comprising a sealing cap positioned on the second end of the wick element, the sealing cap sealing the open channel at the second end of the wick element.

9. A humidifier as set forth in claim 8, wherein the sealing cap forces an air flow entering the open channel through the first end to exit the wick element through the sidewall.

10. A humidifier as set forth in claim 1, wherein the air outlet in positioned through the top portion of the humidification unit.

11. A humidifier as set forth in claim 10, wherein the fan assembly is positioned in the interior space, between the top portion of the humidification unit and the second end of the wick element.

12. A humidifier as set forth in claims 11, wherein the fan assembly draws an air flow into the interior space of the humidification unit through the air inlet and the wick element, and discharges the air flow through the air outlet.

13. An humidifier comprising:

a humidification unit having front, back, top, and bottom portions defining an interior space;

a reservoir positioned at the bottom portion, in the interior space of the humidification unit, and including a centrally located air inlet and a water tank interface extending through the back portion of the humidification unit;

an air outlet through which air may exit the interior space of humidification unit;

a wick element having a first end and a second end, the first end being removeably positionable in the reservoir about the air inlet;

a fan assemble positioned in the interior space of the humidification unit, interposed between the air outlet and the wick element;

a water tank including a bottom end having a pair of support members defining a recess portion there between, the water tank being removeably positionable on the water tank interface with the water tank interface located in the recess portion of the water tank, wherein the support members of the water tank carry the load of the water tank when positioned on the water tank interface.

14. A humidifier as set forth in claim 13, where in the water tank includes a valve located in the recess portion, the water tank interface actuating the valve into an open position when the water tank is positioned on the water tank interface.

15. A humidifier as set forth in claim 13, wherein the wick element includes a closed loop side wall defining an open channel between the first end and the second end.

16. A humidifier as set forth in claim 15, the wick element further comprising a sealing cap removeably positionable on the second end of the wick element, the sealing cap closing the open channel at the second end of the wick element.

17. A humidifier as set forth in claim 16, wherein the sealing cap forces an air flow entering the open channel of the wick element through the first end to exit the wick element through the sidewall.

18. A humidifier as set forth in claim 13, wherein the air outlet in positioned through the top portion of the humidification unit.

19. A humidifier as set forth in claim 18, wherein the fan assembly is positioned between the top portion of the humidification unit and the second end of the wick element.

* * * * *